US007949270B2

(12) United States Patent
Hamada

(10) Patent No.: US 7,949,270 B2
(45) Date of Patent: May 24, 2011

(54) DEVELOPMENT METHOD AND IMAGE FORMING APPARATUS

(75) Inventor: Toshimasa Hamada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 707 days.

(21) Appl. No.: 11/954,478

(22) Filed: Dec. 12, 2007

(65) Prior Publication Data

US 2008/0145077 A1 Jun. 19, 2008

(30) Foreign Application Priority Data

Dec. 13, 2006 (JP) ..... 2006-336047

(51) Int. Cl.
*G03G 15/06* (2006.01)

(52) U.S. Cl. ..... 399/55; 399/56; 399/270; 399/285

(58) Field of Classification Search ..... 399/55, 399/56, 270, 285

See application file for complete search history.

(56) References Cited

U.S. PATENT DOCUMENTS 5,999,782 A * 12/1999 Iguchi et al. ..... 399/270
6,163,663 A * 12/2000 Shinohara et al. ..... 399/55
2009/0317143 A1* 12/2009 Hamada ..... 399/270

FOREIGN PATENT DOCUMENTS

JP 2933699 5/1999
JP 2004-295148 10/2004

* cited by examiner

*Primary Examiner* — Ryan D Walsh

(74) *Attorney, Agent, or Firm* — Renner, Otto, Boisselle & Sklar, LLP

(57) ABSTRACT

In an embodiment in which an electrostatic latent image formed on the surface of a photoreceptor is developed with a toner by applying an oscillating bias voltage in which a development-side electrical potential and an opposite development-side electrical potential alternate with each other, between a development sleeve of a development roller and the photoreceptor, the development-side electrical potential is applied in two stages, and, in the two-staged development-side electrical potential, the absolute value of a first electrical potential V1 that is initially applied is larger than the absolute value of a second electrical potential V2 that is subsequently applied.

10 Claims, 10 Drawing Sheets

DEVELOPMENT METHOD AND IMAGE FORMING APPARATUS

CROSS REFERENCE TO RELATED APPLICATIONS

This application claims priority under 35 U.S.C. §119(a) on Japanese Patent Application No. 2006-336047 filed in Japan on Dec. 13, 2006, the entire contents of which are hereby incorporated by reference.

BACKGROUND OF THE INVENTION

1. Field of Invention

The present invention relates to a development method that can be applied to an electrophotographic image forming apparatus such as a copy machine, printer, or facsimile device, and further relates to an image forming apparatus. More specifically, the present invention relates to a method for developing an electrostatic latent image that is formed on the surface of an electrostatic latent image bearing member with a toner, and further relates to an image forming apparatus.

2. Related Art

In an electrophotographic image forming apparatus, a development method has been adopted in which an electrostatic latent image is developed so as to make the image visible (developing) by electrically charging the surface of an electrostatic latent image bearing member (such as a photoreceptor) and forming the electrostatic latent image by exposing the image to the electrically charged region.

As such a development method, a development method has been used in which, using a single-component developer containing a toner or a two-component developer containing a carrier and a toner, by frictionally charging the toner so that the toner is attracted with the electrostatic force of an electrostatic latent image on the surface of the electrostatic latent image bearing member, the electrostatic latent image is developed, thus forming a toner image.

For example, when a two-component developer is used, a method has been adopted in which a magnetic brush is formed with the carrier on a developer bearing member (such as development roller) in a developing apparatus and an electrostatic latent image is developed by applying a bias voltage between the developer bearing member and an electrostatic latent image bearing member.

Also, regardless of whether the developer is single-component or two-component developer, development may be performed using a toner that is electrically charged with a polarity opposite to the surface potential of an electrically charged electrostatic latent image bearing member, or reversal development may be performed using a toner that is electrically charged with a polarity the same as the surface potential that is charged to the electrostatic latent image bearing member.

Furthermore, an electrostatic latent image that is formed on an electrostatic latent image bearing member may be developed with the toner by applying an oscillating bias voltage between the developer bearing member and the electrostatic latent image bearing member. In this oscillating bias voltage, a development-side electrical potential V2' that can apply an electrostatic force to the toner to be electrically charged in the direction from the developer bearing member to the electrostatic latent image bearing member and an opposite development-side electrical potential V3' that can apply an electrostatic force to the toner in the direction from the electrostatic latent image bearing member to the developer bearing member alternate with each other. For example, a rectangular wave is commonly used whose ratio (duty ratio) of the application time TH during which the development-side electrical potential V2' is applied to the application time T of a cycle during which the development-side electrical potential V2' and the opposite development-side electrical potential V3' are applied is 50% (see FIG. 12 described later).

In such a conventional development method, it is desirable that the electrical charge amount of the toner is increased so as to achieve a smooth image quality with little roughness. However, for example, when a two-component developer is used, the electrostatic force between the carrier and the toner is in proportion to the square of the electrical charged amount. Accordingly, when the electrical charge amount of the toner is increased, the separation rate of the carrier from the toner decreases. As a result, the utilization efficiency of the toner deteriorates and the image density is reduced. In order to increase the image density, the Vpp (peak-to-peak voltage) of the oscillating bias voltage can be increased. However, if the Vpp is increased, so-called dot reproducibility, which is the ease of toner movement to a region that corresponds to an image portion in a region that occupies a large percentage of a region that corresponds to a non-image portion of the electrostatic latent image bearing member, tends to deteriorate.

As a method that achieves not only dot reproducibility but also improved image density, a method has been proposed in which the duty ratio of the oscillating bias voltage is varied. For example, in Japanese Patent 2933699 (published on May 11, 1992), in the oscillating bias voltages, the development-side electrical potential is increased and the application time of the development-side electrical potential is decreased while the opposite development-side electrical potential is decreased to prevent toner separation in a region that corresponds to an image portion and the application time of the opposite development-side electrical potential is increased. By adopting such a configuration, the toner that attaches to the region that corresponds to a non-image portion can be easily removed and the toner in the region that corresponds to an image portion including an intermediate tone portion can be retained.

However, when the inventor of the present invention conducted an experiment, it was found that the image density could not be sufficiently improved while maintaining good dot reproducibility when the duty ratio of the oscillating bias voltage is varied.

FIG. 12 shows rectangular waves with a duty ratio of 50%, and represents a bias waveform of a conventional oscillating bias voltage that is applied between a developer bearing member and an electrostatic latent image bearing member when reversal development is performed with a toner that is electrically charged with a polarity the same as the surface potential that is charged to the electrostatic latent image bearing member. Also, FIG. 13 is a graph that illustrates the relationship between the Vpp (peak-to-peak voltage) of the oscillating bias voltage shown in FIG. 12 and the image density.

As shown in FIG. 12, with respect to the conventional oscillating bias voltage that has rectangular waves of a duty ratio of 50%, when the Vpp is varied with a frequency of 5 kHz, the image density can be changed as shown in FIG. 13. In other words, the Vpp can be increased in order to improve the image density.

With the same conditions, the inventor studied variations in the dot diameter by forming a one-dot image at every eight dots, and found that the dot diameter decreases as the Vpp increases as shown in FIG. 14. Also, observation of each dot revealed that dot omission occurs more easily when the Vpp is large.

Therefore, improvement in the image density and dot reproducibility cannot be achieved at the same time since although the Vpp of the oscillating bias voltage can be increased to increase the image density, this deteriorates the dot reproducibility.

Next, with the oscillating bias voltages shown in FIG. 12, the inventor studied variations in density when an application time TH during which the development-side electrical potential V2' is applied is varied while maintaining a constant application time T3' during which the opposite development-side electrical potential V3' is applied, and found that the image density significantly decreases as the application time TH of the development-side electrical potential V2' decreases as shown in FIG. 15. In other words, it is difficult to maintain the image density since, when the duty ratio of the oscillating bias voltage is varied, the image density tends to decrease as the application time of the development-side electrical potential V2' decreases.

If the absolute value of the development-side electrical potential V2' is increased so as to supplement a decrease in the application time TH of the development-side electrical potential V2', the image density can be slightly increased in some conditions. However, a significant increase in the image density cannot be expected. For example, when the application time TH of the development-side electrical potential V2' is significantly shortened, the image density, on the contrary, decreases even when the application voltage of the development-side electrical potential V2' is increased.

SUMMARY OF THE INVENTION

It is an object of the present invention to provide a development method and an image forming apparatus, in which an oscillating bias voltage is applied between a developer bearing member and an electrostatic latent image bearing member so that an electrostatic latent image formed on the electrostatic latent image bearing member is developed with a toner, that can improve the conventional image density while maintaining good dot reproducibility.

With much study devoted to solving the above-mentioned problems, the inventor found the following.

That is to say, an important point in improving the image density is to utilize toner that can move from a developer bearing member to an electrostatic latent image bearing member as much as possible.

Hereinafter is described an example in which, using a two-component developer containing a carrier and a toner will be explained when an oscillating bias voltage, a development-side electrical potential that can apply an electrostatic force to the toner electrically charged with a polarity the same as the surface potential that is charged to an electrostatic latent image bearing member in the direction from a developer bearing member to the electrostatic latent image bearing member in a development apparatus and an opposite development-side electrical potential that can apply an electrostatic force to the toner in the direction from the electrostatic latent image bearing member to the developer bearing member alternate with each other, is applied between the developer bearing member and the electrostatic latent image bearing member so that reversal development of an electrostatic latent image formed on the electrostatic latent image bearing member is performed with the toner.

In the development apparatus, the toner is attached to a carrier that is supported by the developer bearing member with an electrostatic force (Coulomb force) caused by frictional electric charge. In particular, when a toner with a high electrical charge amount is used, since the electrostatic force between the carrier and the toner increases in proportion to the square of the electrical charge amount, the toner is more difficult to separate from the carrier. The toner that has been attached to the carrier with an electrostatic force as described above can move toward the electrostatic latent image bearing member owing to the effects of the oscillating bias voltage.

Accordingly, in considering development of an electrostatic latent image formed on the electrostatic latent image bearing member with a toner, the development can be divided into the following two steps: a step of separating the toner from the carrier and a step of moving the separated toner to the side with the electrostatic latent image bearing member.

First, in order to separate the toner from the carrier, the toner is separated from the carrier by applying a high voltage at an early stage of application in relation to the development-side electrical potential in the oscillating bias voltage.

Next, in relation to the development-side electrical potential, a voltage with a smaller absolute value than the voltage initially applied is applied so as to move the toner separated from the carrier to the electrostatic latent image bearing member. Even with application of such a small voltage, the toner can be moved to the electrostatic latent image bearing member since the toner separated from the carrier hardly receives any electrostatic force other than that of an electric field caused by the oscillating bias voltage.

From this perspective, the present invention was completed with a discovery that an effect of improved image density can be achieved by applying the development-side electrical potential between the developer bearing member and the electrostatic latent image bearing member in two stages: a first electrical potential V1 and a second electrical potential V2 that is smaller than the first electrical potential V1.

Here, the first electrical potential V1 mainly takes a role of separating the toner from the carrier so as to increase the number of toner that contributes to development. Also, the second electrical potential V2 mainly takes a role of moving the toner separated from the carrier toward the electrostatic latent image bearing member.

The present invention is based on the above-mentioned knowledge, and provides the following development method and image forming apparatus.

(1) Development Method

The present invention provides a development method in which, in an image forming apparatus, by applying an oscillating bias voltage, in which a development-side electrical potential that can apply an electrostatic force to a toner in a development apparatus in the direction from a developer bearing member to an electrostatic latent image bearing member and an opposite development-side electrical potential that can apply an electrostatic force to the toner in the direction from the electrostatic latent image bearing member to the developer bearing member alternate with each other, between the developer bearing member and the electrostatic latent image bearing member, an electrostatic latent image formed on the surface of the electrostatic latent image bearing member is developed with the toner, the development method comprising a first application step of initially applying a first electrical potential V1 as the development-side electrical potential and a second application step of applying a second electrical potential V2 as the development-side electrical potential subsequent to the first application step, in which the absolute value of the first electrical potential V1 is larger than the absolute value of the second electrical potential V2.

(2) Image Forming Apparatus

In a specific configuration, the image forming apparatus according to the present invention is an image forming apparatus that is provided with an electrostatic latent image bearing member, a charging apparatus that electrically charges the surface of the electrostatic latent image bearing member, an exposing apparatus that forms an electrostatic latent image on the surface of the electrostatic latent image bearing member that is electrically charged by the charging apparatus by exposing the surface, and a development apparatus having a developer bearing member, the image forming apparatus forming an electrophotographic image by applying an oscillating bias voltage, in which a development-side electrical potential that can apply an electrostatic force to a toner in the development apparatus in the direction from the developer bearing member to the electrostatic latent image bearing member and an opposite development-side electrical potential that can apply an electrostatic force to the toner in the direction from the electrostatic latent image bearing member to the developer bearing member alternate with each other, between the developer bearing member and the electrostatic latent image bearing member, an electrostatic latent image formed on the surface of the electrostatic latent image bearing member by the exposing apparatus is developed with the toner. An example of the image forming apparatus can be illustrated as an image forming apparatus in which, when the development-side electrical potential is applied in two stages with the electrical potential initially applied referred to as a first electrical potential V1 and the electrical potential applied subsequently referred to as a second electrical potential V2, the absolute value of the first electrical potential V1 is larger than the absolute value of the second electrical potential V2.

With an image forming apparatus according to the present invention, a better-than-conventional image density can be achieved while maintaining good dot reproducibility since the development-side electrical potential of the oscillating bias voltage is applied in two stages between the developer bearing member and the electrostatic latent image bearing member, and in the two-staged development-side electrical potential, the absolute value of the first electrical potential V1 that is initially applied is larger than the absolute value of the second electrical potential V2 that is subsequently applied, In an image forming apparatus according to the present invention, reversal development can be performed using a toner that is electrically charged with a polarity the same as the surface potential that is charged to the electrostatic latent image bearing member.

In this case, it is preferable that the following formula (1) is satisfied with respect to the first electrical potential V1 and the second electrical potential V2.

$$|V1-V2|>30\ V \quad (1)$$

In this case, it is possible to achieve an image density that is at or above a predetermined prescribed value while maintaining good dot reproducibility.

The upper limit value for |V1−V2| may be but is not limited to approximately 500 V.

Also, in performing the reversal development, when an electrical potential of a region that corresponds to the image portion of the electrostatic latent image bearing member is an image portion electrical potential VL and the opposite development-side electrical potential is a third electrical potential V3, it is preferable that the following formula (2) or formula (3) is satisfied.

When the charged polarity of the toner is negative V3−VL<200 V (2)

When the charged polarity of the toner is positive VL−V3<200 V (3)

In this case, it is possible to further improve the image density while maintaining much better dot reproducibility.

Here, a region that corresponds to an image portion of the electrostatic latent image bearing member is a region that has been exposed in the electrostatic latent image bearing member, and the electrical potential thereof may be set to a value that has been set in advance for the image portion.

The lower limit value of "V3−VL" when the charged polarity of the toner is a negative polarity and the lower limit value of "VL−V3" when the charged polarity of the toner is a positive polarity may be but is not limited to approximately −200 V.

Also, in performing the reversal development, when the electrical potential of the region that corresponds to the image portion of the electrostatic latent image bearing member is referred to as an image portion electrical potential VL, the electrical potential of the region that corresponds to the non-image portion of the electrostatic latent image bearing member is referred to as a non-image portion electrical potential V0, the opposite development-side electrical potential is referred to as a third electrical potential V3, the time during which the first electrical potential V1 is applied is referred to as a first application time T1, the time during which the second electrical potential V2 is applied is referred to as a second application time T2, and the time during which the third electrical potential V3 is applied is referred to as a third application time T3, it is preferable that a time average electrical potential Va represented by the following formula (4) is positioned between the image portion electrical potential VL and the non-image portion electrical potential V0, and that the absolute value of the second electrical potential V2 is set larger than the absolute value of the non-image portion electrical potential V0.

$$Va=(V1\times T1+V2\times T2+V3\times T3)/(T1+T2+T3) \quad (4)$$

In this case, it is possible to obtain an adequate image density while effectively preventing fogging in the non-image portion.

At this time, the region that corresponds to the non-image portion of the electrostatic latent image bearing member is a region that has not been exposed in the electrostatic latent image bearing member, and the electrical potential thereof may be set to a value that has been set in advance for the non-image portion.

As described above, the present invention provides a development method and an image forming apparatus, in which an oscillating bias voltage is applied between a developer bearing member and an electrostatic latent image bearing member and an electrostatic latent image formed on the electrostatic latent image bearing member is developed with a toner, the development method and the image forming apparatus being capable of improving the conventional image density while maintaining good dot reproducibility.

DESCRIPTION OF THE PREFERRED EMBODIMENTS

Hereinafter, embodiments of the present invention will be described with reference to the accompanying drawings. The embodiments hereinafter described are simply examples of embodiments of the present invention, and do not limit the technical scope of the present invention.

Figure 1:
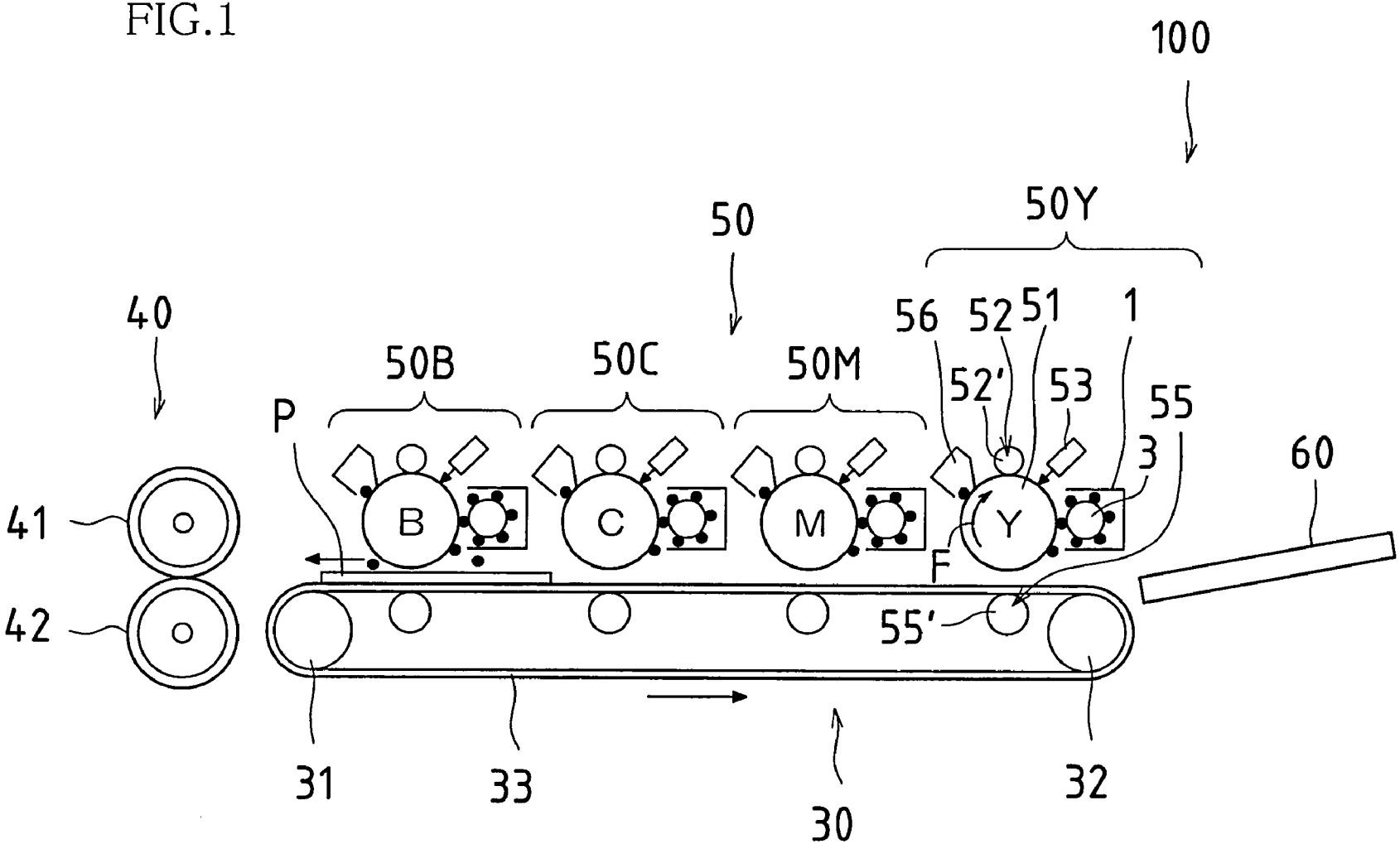
FIG. 1 is a pattern diagram that illustrates the schematic configuration of an image forming apparatus that performs a development method according to the present invention.

FIG. 1 is a pattern diagram that illustrates a schematic configuration of an image forming apparatus that performs a development method according to the present invention.

First, using a pattern diagram shown in FIG. 1, an electrophotographic image forming apparatus 100 that performs a development method that represents an embodiment according to the present invention will be described. In FIG. 1, as the image forming apparatus 100, a tandem-type color image forming apparatus that is provided with a plurality of electrostatic latent image bearing members (photoreceptors in this example) is illustrated, but the image forming apparatus 100 may be a multiple-rotation-type color image forming apparatus that forms a color image with a single electrostatic latent image bearing member or a monochrome image forming apparatus, and the configuration of an image forming apparatus that performs a development method according to the present invention is not in any way limited to the configuration shown in FIG. 1.

The image forming apparatus 100 in this example is a printer connected via a network that forms a color image or a monochrome image on a transfer receiving member P such as recording paper based on the image data transmitted from terminal devices not shown or the image data read with a scanner.

The image forming apparatus 100 is provided with an image forming station portion 50, a transport portion 30, a fixing apparatus 40, and a feed tray 60.

The image forming station portion 50 is configured with four image forming stations 50Y, 50M, 50C, and 50B for yellow images, magenta images, cyan images, and black images, respectively.

More specifically, the yellow image forming station 50Y, the magenta image forming station 50M, the cyan image forming station 50C, and the black image forming station 50B are disposed in this order from the side with the feed tray 60 between the feed tray 60 and the fixing apparatus 40.

The image forming stations 50Y, 50M, 50C, and 50B for the respective colors have substantially the same configuration, and form yellow, magenta, cyan, and black images according to the image data that correspond to each color so that the images are eventually transferred onto the transfer receiving member P.

In FIG. 1, the components of the respective image forming stations are shown with alphanumeric references on the yellow image forming station 50Y as a representative, and the alphanumeric references of the components of the other image forming stations 50M, 50C, and 50B are omitted.

The image forming stations 50Y, 50M, 50C, and 50B are respectively provided with a photoreceptor 51, and a charging apparatus 52, an exposing apparatus 53, a development apparatus 1, a bias application means 70 (corresponding "voltage application section" of the present invention; not shown in FIG. 1, see FIG. 2 described later), a transfer apparatus 55, and a cleaning apparatus 56 are disposed around the photoreceptor 51.

The photoreceptor 51 is in the shape of a drum on the surface of which a photosensitive material is provided, and is rotationally driven in a predetermined direction (in the direction shown with an arrow F in the drawing). The charging apparatus 52 uniformly (evenly) charges the surface of the photoreceptor 51, and in this embodiment, the charging apparatus 52 is provided with a charging roller 52'.

The exposing apparatus 53 exposes the surface of the photoreceptor 51 that is electrically charged with the charging apparatus 52, and forms an electrostatic latent image on the surface of the photoreceptor 51. The exposing apparatus 53 forms an electrostatic latent image in a corresponding color when image data that corresponds to yellow, magenta, cyan, or black is entered respectively according to the image forming station 50Y, 50M, 50C, or 50B. As the exposing apparatus 53, a laser scanning unit (LSU) may be used that is provided with a laser irradiation portion and a reflection mirror or a write device (such as a write head) in which light emitting elements such as ELs and LEDs are arranged in an array.

The development apparatus 1 is provided with a developer bearing member (development roller in this example) 3 that carries developer. The development roller 3 is configured so that the developer is transported to a development region in which a toner can move to the photoreceptor 51. In this embodiment, the development apparatus 1 uses a two-component developer containing a toner and a carrier, and forms a toner image (visible image) by performing reversal developing with the toner of an electrostatic image that has been formed on the surface of the photoreceptor 51 by the exposing apparatus 53.

The development apparatus 1 contains yellow, magenta, cyan, or black developer according to image formation of the respective image forming stations 50Y, 50M, 50C, and 50B. The developer contains a toner that is electrically charged with a polarity the same as the surface potential that is charged to the electrically charged photoreceptor 51. In this example, the polarity of the surface potential that is charged to the electrically charged photoreceptor 51 and the charged polarity of the toner used are both negative.

Figure 2:
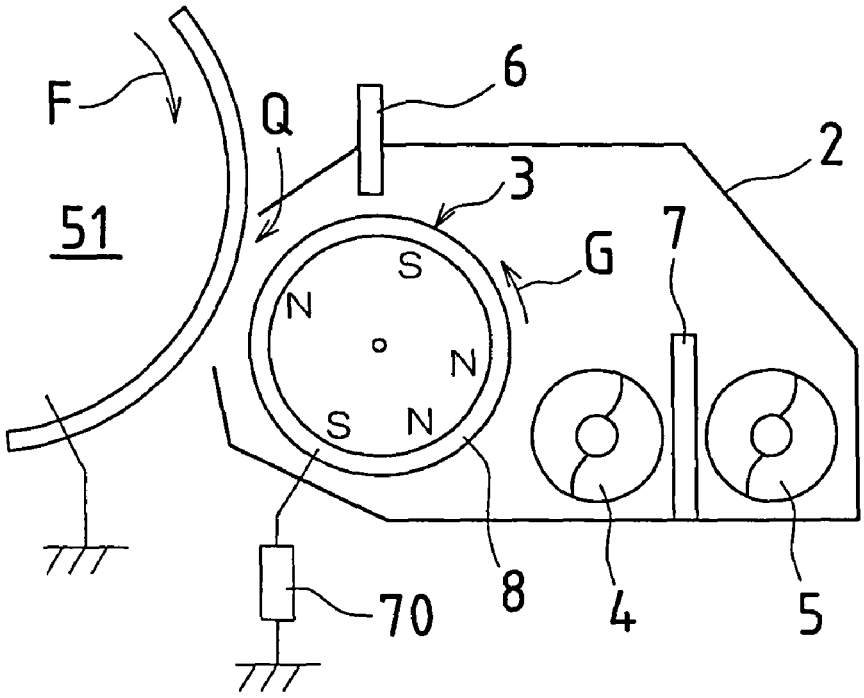
FIG. 2 is a side view that illustrates the schematic configuration of a development apparatus in the respective image forming stations shown in FIG. 1.

The bias application means 70 applies an oscillating bias voltage between the development roller 3 and the photoreceptor 51 in a continuous and periodic manner (see FIG. 2). The oscillating bias voltage is a voltage in which a development-side electrical potential that can apply an electrostatic force to the toner to be electrically charged in the direction from the development roller 3 to the photoreceptor 51 and an opposite development-side electrical potential that can apply an electrostatic force to the toner to be electrically charged in the direction from the photoreceptor 51 to the development roller 3 alternate with each other. The oscillating bias voltage will be described in detail later.

The transfer apparatus 55 transfers a toner image on the photoreceptor 51 to the transfer receiving member P that is transported by a transport belt 33 to be described later, and is provided with a transfer roller 55' to which a bias voltage that has an electrical polarity (positive in this example) opposite to the charged polarity of the toner. The cleaning apparatus 56 removes the toner remaining on the photoreceptor 51 after the image transfer to the transfer receiving member P.

The transport portion 30 is provided with a drive roller 31, an idler roller 32, and the transport belt 33, and transports the transfer receiving member P to which toner images in the respective colors are transferred in the image forming stations 50Y, 50M, 50C, and 50B. The transport belt 33 is routed around the drive roller 31 and the idler roller 32, and transports the transfer receiving member P that is fed from the feed tray 60 to each of the image forming stations 50Y, 50M, 50C, and 50B in a sequential order. The fixing apparatus 40 is provided with a hot roller 41 and a pressure roller 42, and by transporting the transfer receiving member P to a nip portion of the hot roller 41 and the pressure roller 42, fixes the toner image on the transfer receiving member P by applying heat and pressure to the transfer receiving member P.

In the image forming apparatus 100 in such a configuration, when the transfer receiving member P that is transported by the transport portion 30 passes locations at which the photoreceptor 51 faces the respective image forming stations 50Y, 50M, 50C, and 50B, the toner images on the respective photoreceptors 51 are transferred to the transfer receiving member P the action of a transfer electric field of the transfer rollers 55' that have been disposed below the facing locations with the transport belt 33 therebetween. This layers toner images in the respective colors and thereby forms a full-color image on the transfer receiving member P. The transfer receiving member P on which the toner image is transferred in such a manner is discharged to a discharge tray not shown after the fixing apparatus 40 performs a fixing process of the toner image.

Hereinafter, the development apparatus 1 will be further explained. FIG. 2 is a side view that illustrates a schematic configuration of the development apparatus 1 in the respective image forming stations 50Y, 50M, 50C, and 50B shown in FIG. 1.

As shown in FIG. 2, the development apparatus 1 is provided with, in addition to the above-described development roller 3, a regulation member (regulation blade in this example) 6 that regulates the layer compression of developer on the development roller 3, agitating/conveying members (two agitating/conveying screws in this example) 4 and 5 that convey the developer to the development roller 3 and agitate the developer, and a development unit 2 that contains a two-component developer containing a toner and a carrier.

In the development unit 2, the agitating/conveying screws 4 and 5 are disposed. A dividing wall 7 is provided between the agitating/conveying screws 4 and 5 so as to divide the agitating/conveying screws 4 and 5 except for both ends in the axial line direction. In such a configuration, a developer conveying path that is independent with the use of the dividing wall 7 as a boundary is formed within the development unit 2.

Also, in the development apparatus 1, the toner in the developer contained in the development unit 2 is agitated with the carrier by the agitation operation of the agitating/conveying screws 4 and 5 that have been disposed in the development unit 2 so as to be frictionally charged.

More specifically, an opening portion Q for development is provided at a location in the development unit 2 that faces the photoreceptor 51. The development roller 3 is disposed in the development unit 2 in a state in which a part of the development roller 3 is exposed from the opening portion Q of the development unit 2.

The development roller 3 is provided with a magnet roller in which numerous magnetic poles are laid out along the circumferential direction and a nonmagnetic development sleeve 8 in a cylindrical shape that covers the magnet roller, and is configured so that the development sleeve 8 is rotationally driven in a predetermined direction (in the direction shown with arrow G in FIG. 2).

The developer includes a carrier that is composed of a magnetic substance. The developer is attracted to the surface of the development sleeve 8 by the magnetic force of the magnet, and is conveyed on the development sleeve 8 along the rotational direction G of the development sleeve 8. At this time, the carrier is attracted to the surface of the development sleeve 8 by the magnetic force of the magnet roller so as to form a magnetic brush, and the toner is attached to the carrier by Coulomb force due to the frictional electric charge.

In addition, the tip portion of the regulation blade 6 is disposed so as to face the development sleeve 8 in the upstream side of the rotational direction G of the development sleeve 8 in the opening portion Q for development. In this embodiment, the regulation blade 6 is configured so that the layer thickness of the developer formed on the surface of the development roller 3 is regulated.

This enables the development apparatus 1 to form a toner image by supplying a constant amount of developer to a location that faces the photoreceptor 51, attracting the toner in the developer supplied to the facing location with the electrostatic force of an electrostatic latent image formed on the surface of the photoreceptor 51, and then developing the electrostatic latent image. Also, in the development apparatus 1, the toner that has not been supplied for development and the carrier in the developer supplied to the facing location returns to the development unit 2 with the rotation of the development sleeve 8.

Figure 3:
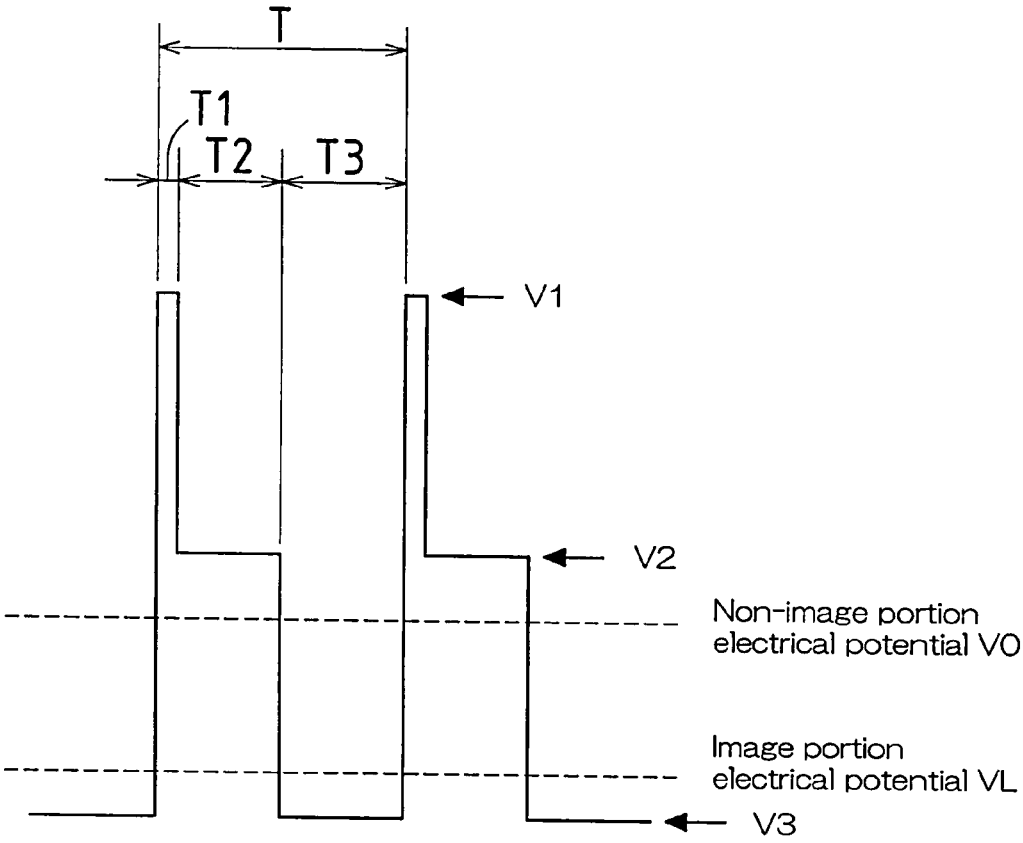
FIG. 3 is a diagram that illustrates an example of a bias waveform of an oscillating bias voltage used in the development method that is performed in the image forming apparatus according to the present invention.

Next, a development method performed in the image forming apparatus 100 will be explained. FIG. 3 is a diagram that illustrates an example of a bias waveform of an oscillating bias voltage used in a development method that is performed in an image forming apparatus 100 according to the present invention.

The bias application means 70 applies a bias voltage that has the three electrical potentials shown in FIG. 3 to the development sleeve 8 of the development roller 3.

In other words, the bias application means 70 applies the development-side electrical potential in the oscillating bias voltage in two stages (first application step and second application step) so that the absolute value of (the peak value of) the first electrical potential V1, which is the electrical potential initially applied (first application step), is larger than the absolute value of (the peak value of) the second electrical potential V2, which is the electrical potential applied subsequently (second application step). In this embodiment, the bias application means 70 is configured with a bias voltage application circuit and a control circuit that controls the bias voltage application circuit.

The oscillating bias voltage applied by the bias application means 70 can vary depending on the relationship between an image portion electrical potential VL in the region that corresponds to the image portion on the photoreceptor 51 and the non-image portion electrical potential V0 that corresponds to the non-image portion on the photoreceptor 51. For this reason, in this example, the image portion electrical potential VL and the non-image portion electrical potential V0 are predetermined set values. In this embodiment, an example in which the respective values are −50 V and −600 V will be hereinafter explained.

Also, in this example, the first electrical potential V1 and the second electrical potential V2 are −1050 V and −850 V, respectively. In this example, the third electrical potential V3, which is an opposite development-side electrical potential in the oscillating bias voltage, is −50 V. Also, when the time during which the first electrical potential V1 in the development-side electrical potential is applied is referred to as a first application time T1, the time during which the second electrical potential V2 of the development-side electrical potential is applied is referred to as a second application time T2, and the time during which the third electrical potential V3 is applied is referred to as a third application time T3, the ratio of the application time (T1+T2) during which the development-side electrical potential is applied to a single-cycle application time T that represents the sum of the first through the third application times T1 through T3 is 50% in this example.

The image forming apparatus 100 in such a configuration first applies the first electrical potential V1 (−1050 V in this example) so as to increase the number of toners that contribute to development so that the toner in the development region is separated from the carrier.

Next, the second electrical potential V2 (−850 V in this example) is applied so as to move the toner that has been separated from the carrier to the side with the photoreceptor 51. Since the toner separated from the carrier receives little electrostatic force other than the electric field from the oscillating bias voltage, the second electrical potential V2 can move the toner to the side with the photoreceptor 51 even when the second electrical potential V2 is smaller than the voltage used to separate the toner from the carrier. This makes it possible to achieve a better-than-conventional image density.

As mentioned above, since the image forming apparatus 100 is configured so that the development-side electrical potential in the oscillating bias voltage is applied in two stages between the development sleeve 8 and the photoreceptor 51, and so that, in the two-staged development-side electrical potential, the absolute value of the first electrical potential V1 that is initially applied is larger than the absolute value of the second electrical potential V2 that is subsequently applied, a better-than-conventional image density can be achieved while maintaining good dot reproducibility.

Incidentally, when the application time of the first electrical potential V1 that is higher than the second electrical potential V2 is increased, the toner easily attaches to the region that corresponds to the non-image portion of the photoreceptor 51, and thereby the amount of the toner attached to the region increases. In this case, the absolute value of the third electrical potential V3 (−50V in this example) has to be increased so as to collect the toner to the side with the development sleeve 8. As described below, this is not preferable from the aspect of dot reproducibility. Thus, it is preferable that the second application time T2 during which the second electrical potential V2 is applied is longer than the first application time T1 during which the first electrical potential V1 is applied. For example, the first application time T1 during which the first electrical potential V1 is applied may be a third or less, and more desirably approximately a tenth, of the second application time T2 during which the second electrical potential V2 is applied.

The lower limit of the first application time T1 may be, but is not limited to, for example, approximately 1% of the second application time T2.

In this embodiment, the bias application means 70 is configured so that the absolute value of the difference between (the peak value of) the first electrical potential V1 and (the peak value of) the second electrical potential V2 is larger than 30 V. In other words, the bias application means 70 is configured so that the relationship represented by the following formula (1) is satisfied in relation to the first electrical potential V1 and the second electrical potential V2.

$$|V1-V2|>30\ V \quad (1)$$

The absolute value of the difference between the first electrical potential V1 and the second electrical potential V2 is 200 V in this example.

In such a configuration, it is possible to achieve an image density that is at or above the predetermined prescribed value while maintaining good dot reproducibility. This will be explained in working examples 2 and 5 below.

In addition, in this embodiment, the bias application means 70 is configured so that the absolute value of the difference between (the peak value of) the third electrical potential V3 and the image portion electrical potential VL is smaller than 200 V. In other words, the bias application means 70 is configured so as to satisfy the relationship represented by the following formula (2) or formula (3) (since the charged polarity of the toner is negative in this example, the relationship represented by the formula (2)) in relation to the image portion electrical potential VL and the third electrical potential V3.

When the charged polarity of the toner is negative $$V3-VL<200\ V \quad (2)$$

When the charged polarity of the toner is positive $$VL-V3<200\ V \quad (3)$$

In such a configuration, it is possible to further improve the image density while maintaining much better dot reproducibility. This will be explained in working examples 3 and 5 below.

In addition, in this embodiment, the bias application means 70 is configured in relation to the first through the third application times T1 through T3 and the first through the third electrical potentials V1 through V3 so that the time average electrical potential Va shown in the following formula (4) is positioned between the image portion electrical potential VL and the non-image portion electrical potential V0.

$$Va=(V1\times T1+V2\times T2+V3\times T3)/(T1+T2+T3) \quad (4)$$

This condition makes it possible to develop the toner in the region that corresponds to the image portion of the photoreceptor 51 and to prevent the toner from being developed in the region that corresponds to the non-image portion. Thus, it is possible to effectively prevent fogging in the non-image portion.

Furthermore, the absolute value of (the peak value of) the second electrical potential V2 is set larger than the absolute value of the non-image portion electrical potential V0. When the absolute value of the second electrical potential V2 is at or lower than the absolute value of the non-image portion electrical potential V0, in the region that corresponds to the non-image portion of the photoreceptor 51, the toner moves from the side with the development sleeve 8 to the photoreceptor 51 only during the application time T1 of the first electrical potential V1, and during the application times T2 and T3 of the second electrical potential V2 and the third electrical potential V3, an electrical field is applied to the returning side from the side with the photoreceptor 51 to the side with the development sleeve 8. In this way, the toner separated from the carrier by the first electrical potential V1 hardly moves to the side with the photoreceptor 51. In other words, in the region that corresponds to the non-image portion of the photoreceptor 51, the toner that moves to the side with the photoreceptor 51 becomes extremely limited, and, for example, in a region that has isolated dots in the region that corresponds to the non-image portion, it is difficult to develop the isolated dots, and for example, clear development of image with a low density becomes impossible.

With respect to this point, in this embodiment, since the absolute value of (the peak value of) the second electrical potential V2 is larger than the absolute value of the non-image portion electrical potential V0, the utilization efficiency of the toner can be improved and the image density can be further improved.

In other words, the bias application means 70 positions the time average electrical potential Va between the image portion electrical potential VL and the non-image portion electrical potential V0, and controls the absolute value of (the peak value of) the second electrical potential V2 to be larger than the absolute value of the non-image portion electrical potential V0. This makes it possible to obtain an adequate image density while suppressing fogging of background in the non-image portion.

Although a two-component developer containing a toner and a carrier was used in the above-mentioned explanation, with a single-component developer, by considering the sleeve as a carrier-equivalent, the same principle can be applied so as to increase the density while insuring dot reproducibility. Accordingly, although a two-component developer containing a toner and a carrier is used in this embodiment, a single-component developer containing a toner may also be used.

Hereinafter, specific working examples according to the present invention will be explained. However, the present invention is not limited to the following working examples.

WORKING EXAMPLE 1

Figure 12:
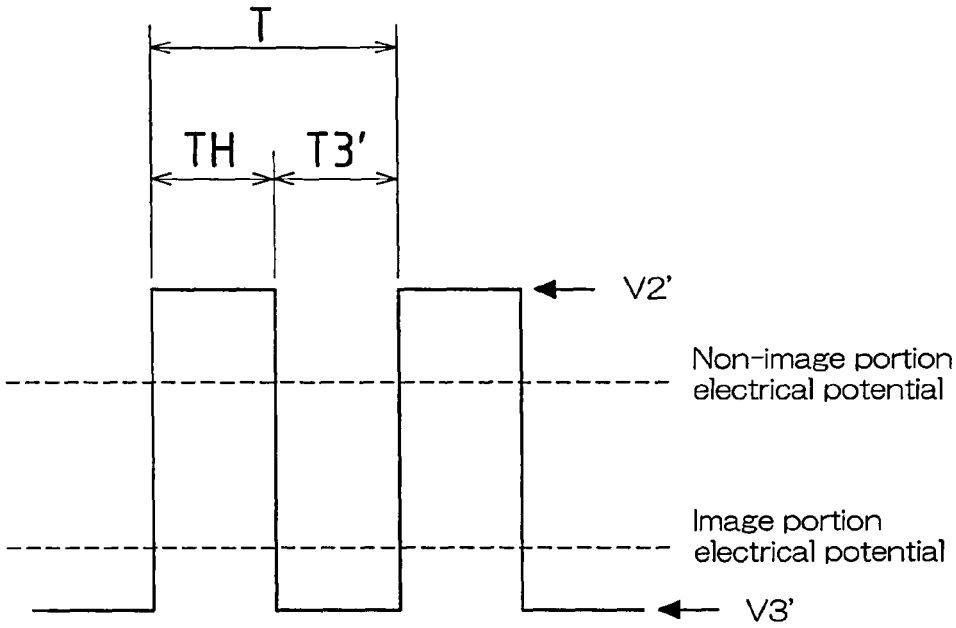
FIG.12 Conventional Art
FIG. 12 shows rectangular waves with a duty ratio of 50%, and represents a bias waveform of a conventional oscillating bias voltage that is applied between a developer bearing member and an electrostatic latent image bearing member when reversal development is performed with a toner that is electrically charged with a polarity the same as the surface potential that is charged to the electrostatic latent image bearing member.
Figure 13:
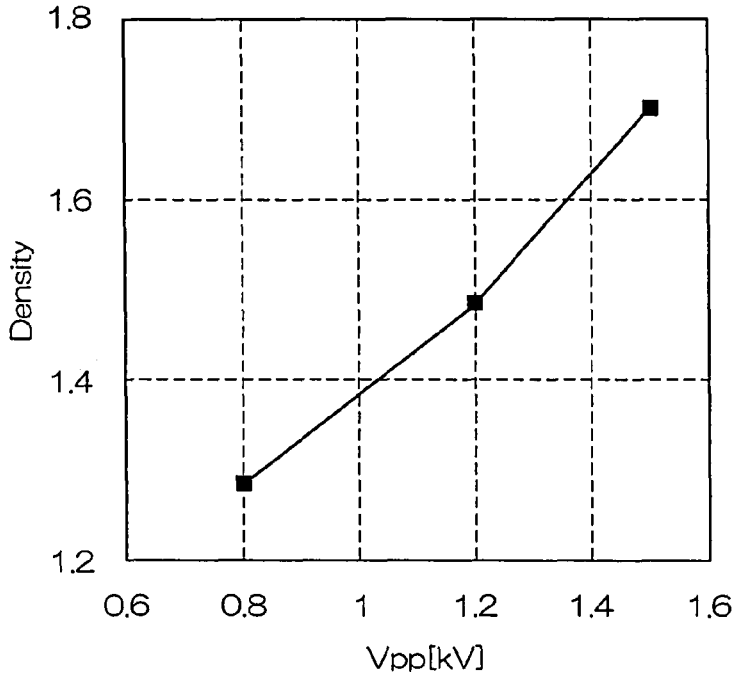
FIG.13 Conventional Art
FIG. 13 is a graph that illustrates the relationship between the Vpp (peak-to-peak voltage) of the oscillating bias voltage shown in FIG. 12 and the image density.
Figure 14:
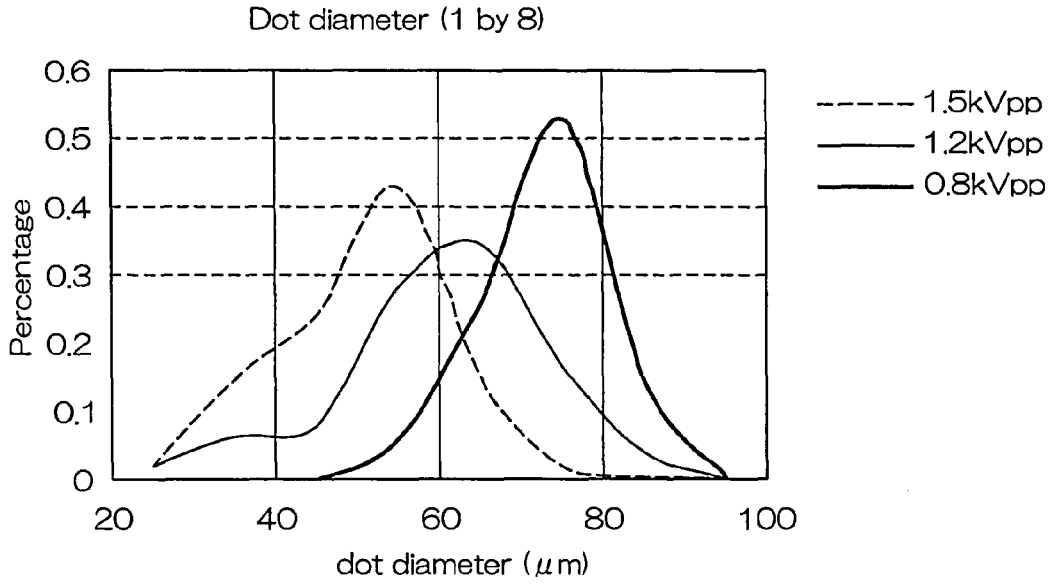
FIG.14 Conventional Art
FIG. 14 is a graph that illustrates the results of a study on variations in dot diameter by forming a one-dot image at every 8 dots with the development using the oscillating bias voltage shown in FIG. 12.
Figure 15:
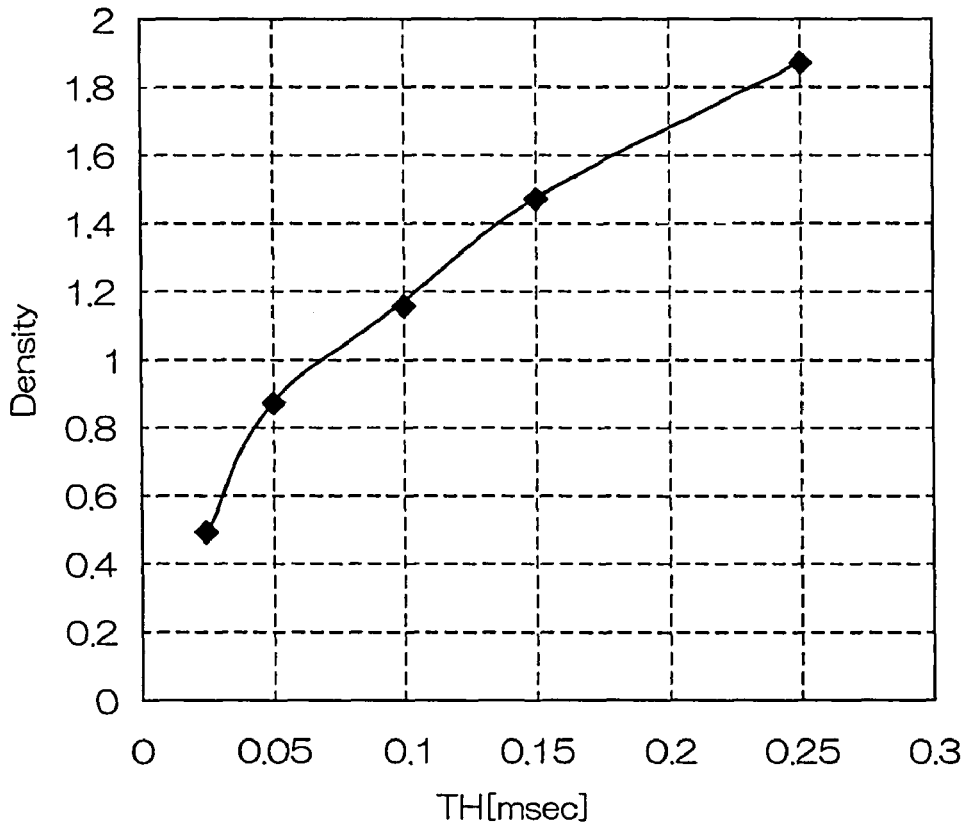
FIG.15 Conventional Art
FIG. 15 is a graph that illustrates the results of a study on the variations in density when, in the oscillating bias voltage shown in FIG. 12, the application time of the development-side electrical potential is varied while the application time of the opposite development-side electrical potential is maintained constant.

On an oscillating bias voltage according to the present invention (see FIG. 3), an experiment was conducted with the first electrical potential V1=−1050 V, the second electrical potential V2=−850 V, and the third electrical potential V3=−50 V with the following application times thereof: first application time T1=0.01 msec, second application time T2=0.09 msec, and third application time T3=0.1 msec (with repeat frequency of 5 kHz). Then, the results were compared with the data of a conventional oscillating bias voltage with a duty ratio of 50%, a repeat frequency of 5 kHz, and a Vpp of 0.8 kV and 1.2 kV (see FIG. 12) to determine the effectiveness.

The Vpp of an oscillating bias voltage according to the present invention is 1 kV. For the conventional oscillating bias voltage with a Vpp of 0.8 kV, the development-side electrical potential V2' is −850 V (non-existence of the first electrical potential V1), and the opposite development-side electrical potential V3' is −50 V. For the conventional oscillating bias voltage with a Vpp of 1.2 kV, the development-side electrical potential V2' is −1050V (non-existence of the first electrical potential V1), and the opposite development-side electrical potential V3' is +150 V.

Figure 4:
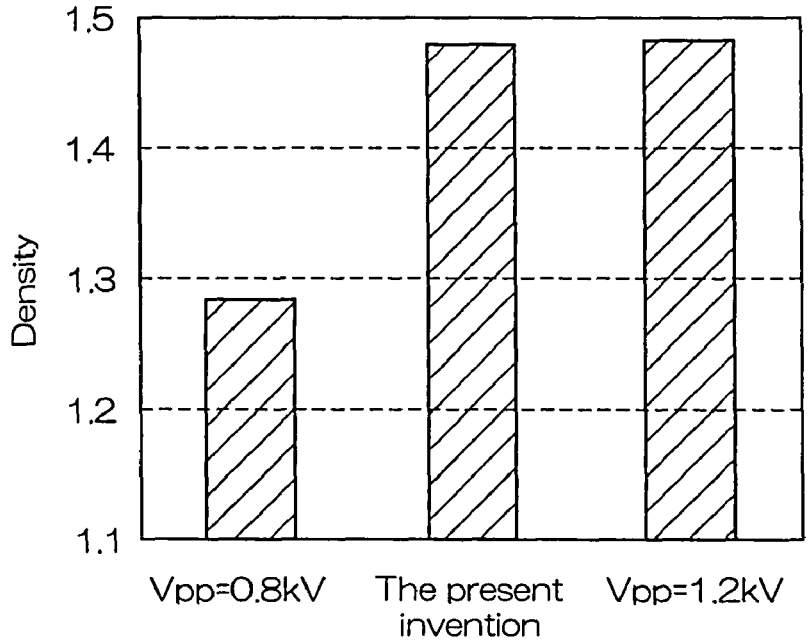
FIG. 4 is a graph that illustrates the image density in development with the oscillating bias voltage according to this invention in comparison with the image density in development with a conventional oscillating bias voltage (with a Vpp of 0.8 kV and with a Vpp of 1.2 kV).
Figure 5:
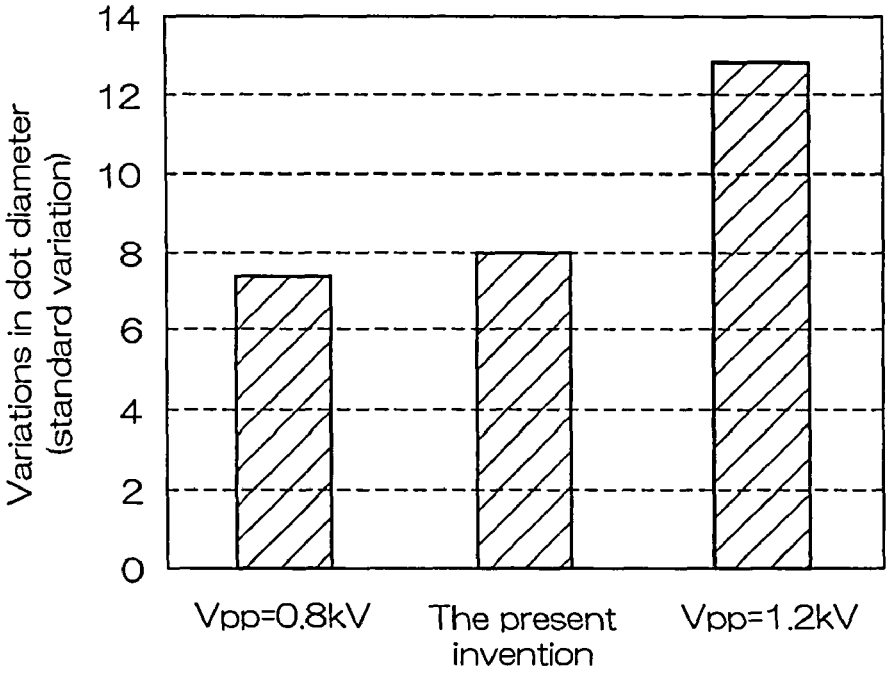
FIG. 5 is a graph that illustrates variations in dot diameter in development with the oscillating bias voltage according to this invention in comparison with variations in dot diameter in development with the conventional oscillating bias voltage (with a Vpp of 0.8 kV and with a Vpp of 1.2 kV).

FIG. 4 is a graph that illustrates the image density in development with an oscillating bias voltage according to this invention in comparison with the image density in development with a conventional oscillating bias voltage (with a Vpp of 0.8 kV and with a Vpp of 1.2 kV). FIG. 5 is a graph that illustrates variations in dot diameter in development with an oscillating bias voltage according to this invention in comparison with variations in dot diameter in development with a conventional oscillating bias voltage (with a Vpp of 0.8 kV and with a Vpp of 1.2 kV).

In development with the oscillating bias voltage according to the present invention, because of the action of the first electrical potential V1, the image density increases to the level approximately the same as that of development with the conventional oscillating bias voltage with a Vpp of 1.2 kV. Meanwhile, variations in dot diameter are maintained to be at a level approximately the same as that of development with the conventional oscillating bias voltage with a Vpp of 0.8 kV since the third electrical potential V3 is set to a value close to the image portion electrical potential VL. In other words, it was confirmed that development with an oscillating bias voltage according to the present invention can improve the image density while maintaining good dot reproducibility.

WORKING EXAMPLE 2

Figure 6:
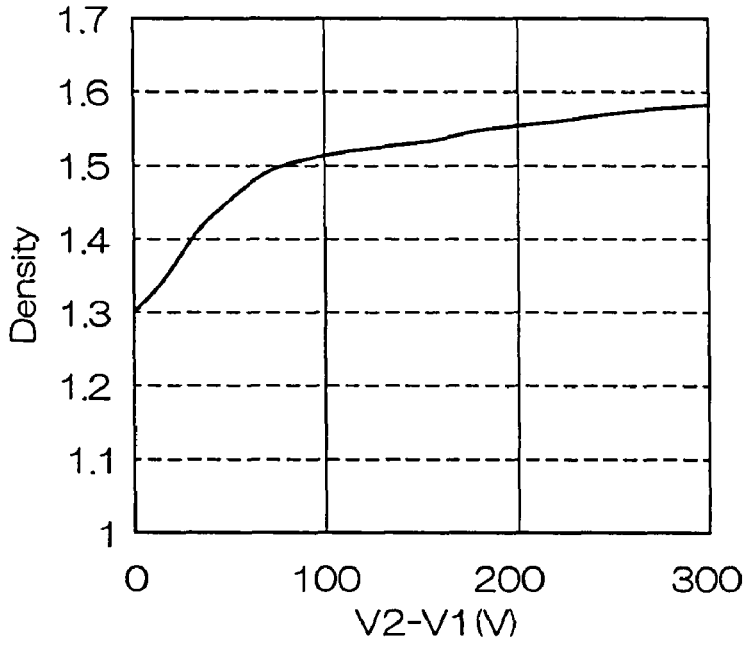
FIG. 6 is a graph that shows the results of a study on the image density in relation to "second electrical potential V2–first electrical potential V1."

FIG. 6 is a graph that illustrates the results of a study on the image density in relation to "second electrical potential V2−first electrical potential V1."

In Working Example 1, the condition |V1−V2|=200 was used. However, as shown in FIG. 6, improvement effects in the image density were also observed when the value |V1−V2| is much smaller. In such an experiment in which the image density was measured with various |V1−V2|, a trend that the density increases as the value |V1−V2| increases was confirmed, and the value of 1.4 or more that is a predetermined prescribed value for the minimum image density with a value larger than 30 V was obtained. Thus, it is desirable that the value |V1−V2| is larger than 30 V.

WORKING EXAMPLE 3

Figure 7:
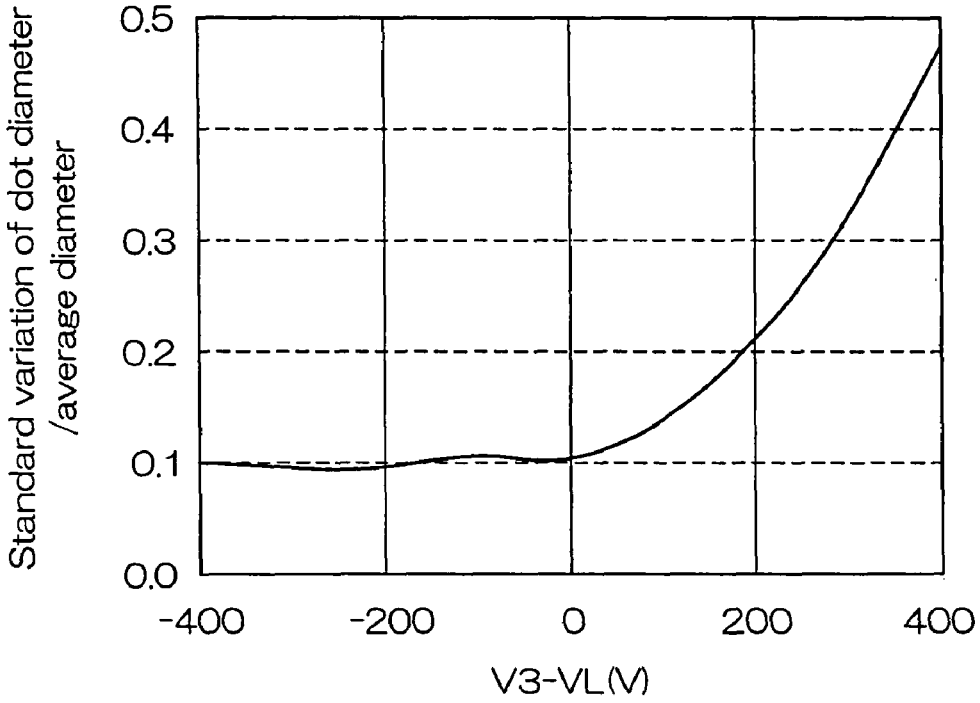
FIG. 7 is a graph that shows the results of a study on variations in dot diameter in relation to "third electrical potential V3–image portion electrical potential VL" with the third electrical potential V3 varied.

FIG. 7 is a graph that shows the results of a study on variations in dot diameter in relation to "third electrical potential V3−image portion electrical potential VL" with the third electrical potential V3 varied.

The third electrical potential V3 has a large effect on the dot reproducibility. As shown in FIG. 7, when the third electrical potential V3 becomes larger than the image portion electrical potential VL, variations in the dot diameter tend to increase. When V3>VL+200, patchy dot increased. Considering these factors, V3−VL<200 is preferable.

WORKING EXAMPLE 4

As described above, it is preferable that the time average electrical potential Va of the first electrical potential V1, the second electrical potential V2, and the third electrical potential V3 is positioned between the image portion electrical potential VL and the non-image portion electrical potential V0. Furthermore, it is preferable that the absolute value of the second electrical potential V2 is larger than the absolute value of the non-image portion electrical potential V0.

Figure 8:
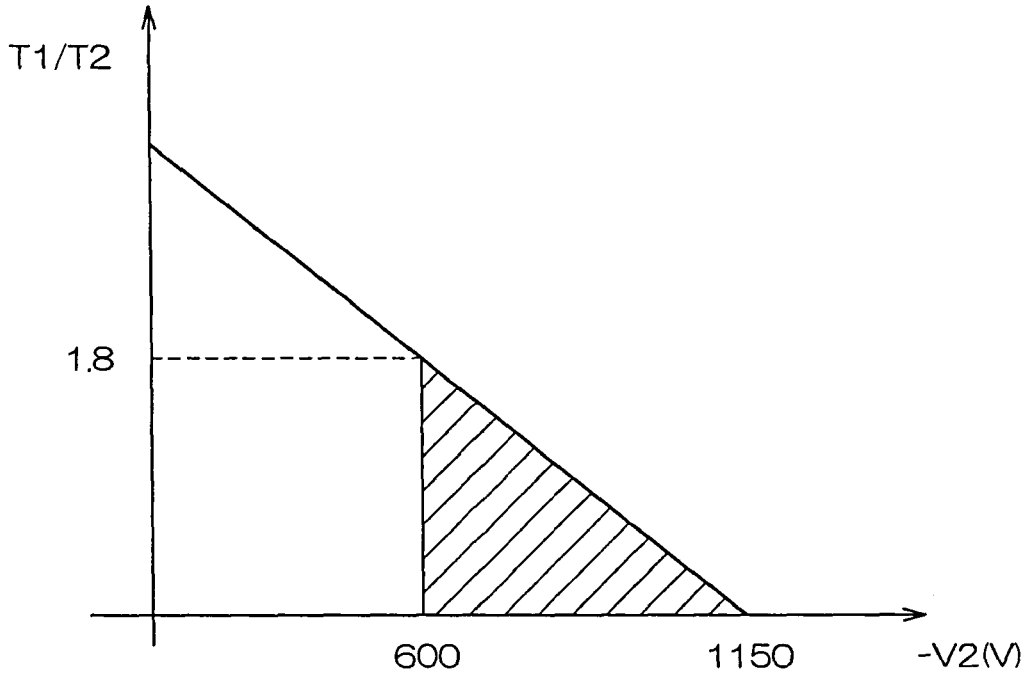
FIG. 8 is a graph that shows the results of a study on the ratio between the first application time T1 and the second application time T2 (T1/T2) in relation to the second electrical potential V2.

When these conditions are adopted, the following numeric values can be set. FIG. 8 is a graph that shows the results of a study on the ratio between the first application time T1 and the second application time T2 (T1/T2) in relation to the second electrical potential V2.

In Working Example 4, with the first electrical potential V1 to be −1450 V, the third electrical potential V3 to be −50 V, the application time T3 of the third electrical potential V3 to be 0.1 msec, and the sum of the application time T1 of the first electrical potential V1 and the application time T2 of the second electrical potential V2 to be 0.1 msec, the conditions in which the absolute value of the second electrical potential V2 becomes larger than the non-image portion electrical potential V0 was sought. As a result, as shown in FIG. 8, the upper limit of the absolute value of the second electrical potential V2 is −1150 V, and as the value becomes closer to −1150 V, the ratio of the first application time T1 and the second application time T2 (T1/T2) becomes smaller. In other words, it is clear that a shorter application time T1 of the first electrical potential V1 is preferable.

WORKING EXAMPLE 5

In the above-explained examples, a case in which an electrically negatively charged toner was used was disclosed, but a case in which an electrically positively charged toner was used was also examined.

Figure 9:
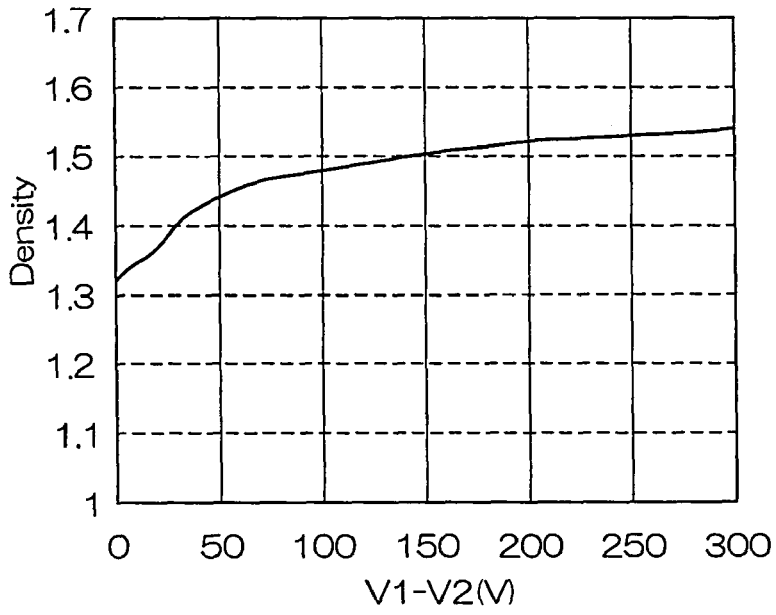
FIG. 9 is a graph that shows the results of a study on the image density in relation to "first electrical potential V1–second electrical potential V2."
Figure 10:
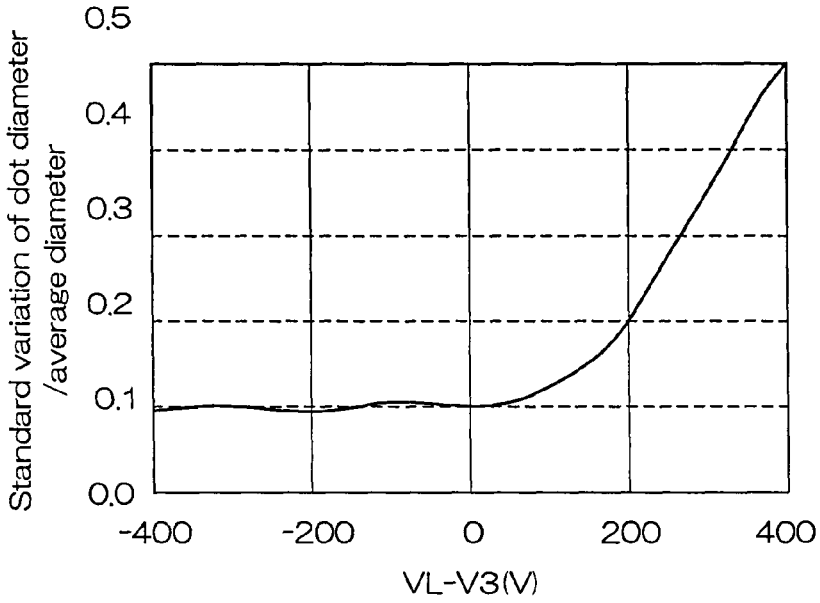
FIG. 10 is a graph that shows the results of a study on dot variations in relation to "image portion electrical potential VL-third electrical potential V3."

FIG. 9 is a graph that shows the results of a study on the image density in relation to "first electrical potential V1−second electrical potential V2." Also, FIG. 10 is a graph that shows the results of a study on dot variations in relation to "image portion electrical potential VL−third electrical potential V3."

As shown in FIGS. 9 and 10, almost the same results were obtained in both relationships as the results when negatively charged toner was used except for numeric reference values.

Figure 11:
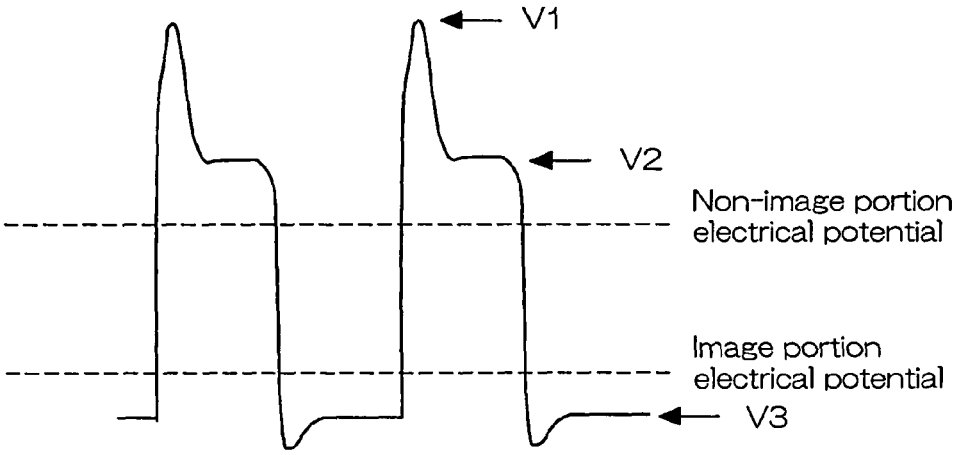
FIG. 11 is a diagram that illustrates an actually applied waveform of the oscillating bias voltage in a working example.

Since more or less overshooting was observed in the waveform of the voltage that was actually applied in the respective working examples, the waveform becomes as shown in FIG. 11. In other words, a state with a larger overshoot on the side with the first electrical potential V1 and the second electrical potential V2 was observed. The above-described effects can be obtained even with such a waveform.

Also, in this working example, an example of (first application time T1+ second application time T2)=(third application time T3), in other words when the total time of the first application time T1 and the second application time T2 equals to the third application time T3, was shown, but is not limited to this. When (first application time T1+second application time T2)<(third application time T3), in other words, when the total time of the first application time T1 and the second application time T2 is shorter than the third application time T3, similar effects can be expected.

The present invention may be embodied in various other forms without departing from the gist or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A development method in an image forming apparatus wherein an oscillating bias voltage, in which a development-side electrical potential that can apply an electrostatic force to a toner in a development apparatus in a direction from a developer bearing member to an electrostatic latent image bearing member and an opposite development-side electrical potential that can apply an electrostatic force to the toner in a direction from the electrostatic latent image bearing member to the developer bearing member alternate with each other, is applied between the developer bearing member and the electrostatic latent image bearing member so that an electrostatic latent image formed on a surface of the electrostatic latent image bearing member is developed with the toner, the development method comprising:

a first application step of initially applying a first electrical potential V1 as the development-side electrical potential; and a second application step of applying a second electrical potential V2 as the development-side electrical potential subsequent to the first application step;

wherein an absolute value of the first electrical potential V1 is set larger than an absolute value of the second electrical potential V2, and a first time period for performing the first application step is set less than a second time period for performing the second application step.

2. The development method according to claim 1, wherein the first time period is a third or less than the second time period.

3. The development method according to claim 2, wherein the first time period is approximately a tenth of the second time period.

4. An image forming apparatus comprising:

a development apparatus which developes an electrostatic latent image formed on a surface of an electrostatic latent image bearing member with a toner on a developer bearing member, and a voltage application section for applying an oscillating bias voltage between the developer bearing member and the electrostatic latent image bearing member, in which a development-side electrical potential that can apply an electrostatic force to the toner in a direction from the developer bearing member to the electrostatic latent image bearing member and an opposite development-side electrical potential that can apply an electrostatic force to the toner in a direction from the electrostatic latent image bearing member to the developer bearing member alternate with each other;

wherein the voltage application section initially applies a first electrical potential V1 as the development-side electrical potential; and subsequently applies a second electrical potential V2 as the development-side electrical potential; and an absolute value of the first electrical potential V1 is set larger than an absolute value of the second electrical potential V2, and a first time period for applying the first electrical potential V1 is set less than a second time period for applying the second electrical potential V2.

5. The image forming apparatus according to claim 4, wherein reversal development is performed using a toner that is electrically charged with a polarity the same as a surface potential that is charged to the electrostatic latent image bearing member.

6. The image forming apparatus according to claim 4, wherein a relationship represented by the following formula (1) is satisfied with the first electrical potential V1 and the second electrical potential V2:

$$|V1-V2|>30\ V \quad (1).$$

7. The image forming apparatus according to claim 6, wherein when an electrical potential of a region that corresponds to an image portion of the electrostatic latent image bearing member is referred to as an image portion electrical potential VL and the opposite development-side electrical potential is referred to as a third electrical potential V3, the voltage application section is set with the third electrical potential V3 so that a relationship represented by either the following formula (2) or formula (3) is satisfied with the image portion electrical potential VL and the third electrical potential V3:

when the charged polarity of the toner is negative V3−VL<200 V (2), and when the charged polarity of the toner is positive VL−V3<200 V (3).

8. The image forming apparatus according to claim 7, wherein when an electrical potential of a region that corresponds to an image portion of the electrostatic latent image bearing member is referred to as an image portion electrical potential VL, an electrical potential of a region that corresponds to a non-image portion of the electrostatic latent image bearing member is referred to as a non-image portion electrical potential V0, the opposite development-side electrical potential is referred to as a third electrical potential V3, a time during which the first electrical potential V1 is applied is referred to as a first application time T1, a time during which the second electrical potential V2 is applied is referred to as a second application time T2, and a time during which a third electrical potential V3 is applied is referred to as a third application time T3, the voltage application section is set so that a time average electrical potential Va that is represented by the following formula (4) is positioned between the image portion electrical potential VL and the non-image portion electrical potential V0:

$$Va=(V1\times T1+V2\times T2+V3\times T3)/(T1+T2+T3) \quad (4), \text{ and}$$

an absolute value of the second electrical potential V2 is set larger than an absolute value of the non-image portion electrical potential V0.

9. The image forming apparatus according to claim 4, wherein the first time period is a third or less than the second time period.

10. The image forming apparatus according to claim 9, wherein the first time period is approximately a tenth of the second time period.

* * * * *